United States Patent [19]

Schenk

[11] 4,141,120

[45] Feb. 27, 1979

[54] APPARATUS FOR CONTROLLING THE MOVEMENTS OF A REED CARRIAGE DURING WARPING

[75] Inventor: Kurt Schenk, Degersheim, Switzerland

[73] Assignee: Maschinenfabrik Benninger AG, Uzwil, Switzerland

[21] Appl. No.: 859,646

[22] Filed: Dec. 12, 1977

[30] Foreign Application Priority Data

Dec. 17, 1976 [CH] Switzerland ..... 15889/76

[51] Int. Cl.[2] ..... D02H 13/26

[52] U.S. Cl. ..... 28/185; 28/191; 28/194; 28/212

[58] Field of Search ..... 28/185, 190, 191, 192, 28/194, 212; 226/110; 242/36, 45, 186, 75, 147

[56] References Cited

U.S. PATENT DOCUMENTS

| | | | |
|---|---|---|---|
| 1,096,702 | 5/1914 | Fleischer et al. | 28/191 X |
| 2,252,419 | 8/1941 | Slaughter | 28/194 X |
| 2,674,110 | 4/1954 | Roughsedge et al. | 28/191 X |
| 2,688,789 | 9/1954 | Durgee | 28/194 X |
| 3,409,194 | 11/1968 | Whitehead | 28/194 X |
| 3,599,300 | 8/1971 | Timbie | 28/185 |
| 3,777,959 | 12/1973 | Seney | 28/185 X |
| 4,074,404 | 2/1978 | Schenk | 28/185 |

*Primary Examiner*—Louis Rimrodt
*Attorney, Agent, or Firm*—Werner W. Kleeman

[57] ABSTRACT

An apparatus for controlling the movements of a reed carriage of a warping machine during warping a package composed of successive adjacent warp sections wound onto the warping drum of the warping machine, wherein the displacement of the carriage for producing the shifted deposition of the warp section-layers during winding is accomplished by a reed carriage-displacement spindle which is driven by means of a pre-adjustable change-speed gearing as a function of the rotation of the warping drum. A processor is provided which, on the basis of infed data, determines the number of revolutions of the reed carriage-displacement spindle needed for shifting the reed carriage during winding a warp section have a predetermined number of threads and also on the basis of further infed data concerning the warp sections to be wound determines the number of revolutions of the spindle in the opposite rotational sense needed in order to displace the carriage, following completion of the winding of a warp section, back into the starting position for the winding of the next warp section. The processor upon recall emits signals which with the aid of further means initiates such return displacement of the reed carriage.

10 Claims, 13 Drawing Figures

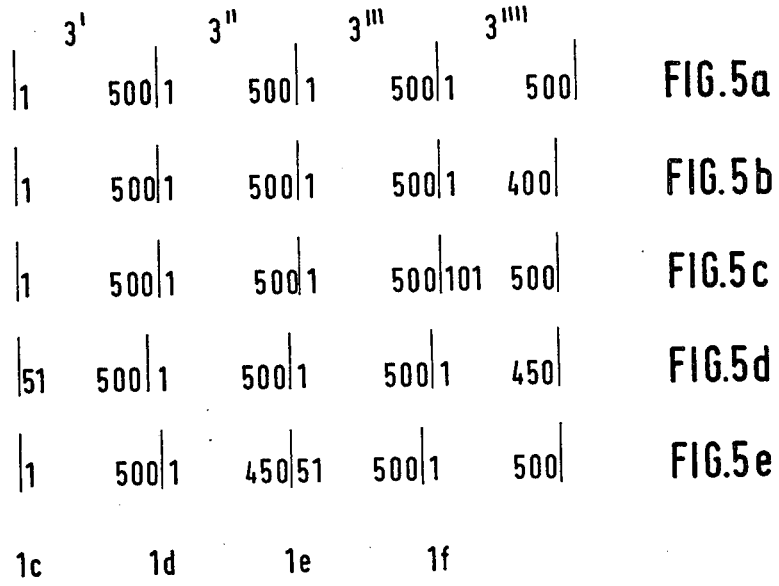
3'
3''
3'''
3''''
1 500 1 500 1 500 1 500
FIG.5a
1 500 1 500 1 500 1 400
FIG.5b
1 500 1 500 1 500 101 500
FIG.5c
51 500 1 500 1 500 1 450
FIG.5d
1 500 1 450 51 500 1 500
FIG.5e
1c 1d 1e 1f
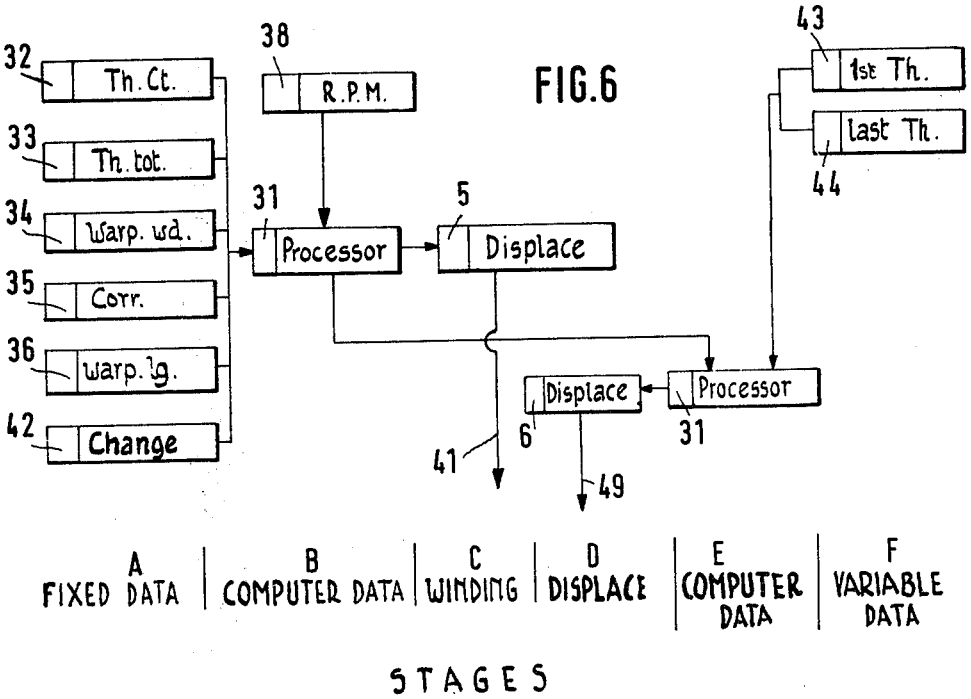
FIG.6
32 Th. Ct.
33 Th. tot.
34 Warp. wd.
35 Corr.
36 Warp. lg.
42 Change
38 R.P.M.
31 Processor
5 Displace
41
43 1st Th.
44 last Th.
Displace 6'
Processor 31
49
A FIXED DATA
B COMPUTER DATA
C WINDING
D DISPLACE
E COMPUTER DATA
F VARIABLE DATA
STAGES

APPARATUS FOR CONTROLLING THE MOVEMENTS OF A REED CARRIAGE DURING WARPING

CROSS-REFERENCE TO RELATED CASE

This application is a related application to my copending, commonly assigned, U.S. application. Ser. No. 789,545, filed Apr. 21, 1977, now U.S Pat. No. 4,074,404, granted Feb. 21, 1978.

BACKGROUND OF THE INVENTION

The present invention relates to a new and improved construction of apparatus for controlling the movements of a reed carriage carrying the reed of a warping machine during warping a package composed of successive adjacent warp sections wound upon the warping drum or warping reel of the warping machine.

In contrast to beam warping, during warping it is known to wind-up upon a warping drum or reel the total number of threads desired for a given warp in the form of adjacently situated warp sections. Thereafter, these warp sections can be simultaneously wound in their full width upon a weaver's beam or back beam or presented to a sizing machine.

To this end the threads withdrawn from the packages of bobbins of a bobbin creel are each delivered by means of a stop motion and a yarn brake to a warping reed. The warping reed arranges the threads in the desired warp section-width and set of warp. Furthermore, owing to the continuous and stepwise displacements imparted to the warping reed in the lengthwise direction of the warping drum there is accomplished, on the one hand, the shifting of the deposition of the warp section-layers upon the warping drum in accordance with the feed during winding, and, on the other hand, the displacement of the application of the warp sections in each case by the width of a warp section upon the warping drum after reaching the desired depth of the warp section and warp length, respectively.

Control of the deposition of the warp section-layers upon the warping drum or reel at an inclination along the cone or the free side surface of the warping section which previously was subjected to the warping process is accomplished by means of an adjustable change-speed gearing which transmits the rotation of the warping drum to a reed carriage-displacment spindle. A reed carriage engages with the threading of such spindle, the reed carriage supporting the reed, and owing to the rotation of the spindle is displaced in the lengthwise direction of the axis of the warping drum. In order to determine the point of application of a warp section which is to be wound at the warping drum and for shifting such point of application, respectively, following the winding of a warp section in the desired length into the position for the next warp section, as a general rule heretofore the reed carriage was disengaged from the displacement spindle and after displacement thereof along the spindle was again brought into engagement with the threaded spindle in the position desired for the next warp section.

Such displacements of the reed by the reed carriage, from one point of application to the other point of application, was carried out heretofore manually, preferably with the aid of specially developed mechanical warp section width-adjustment devices, the purpose of which was to locate in the correct position the different points of application without any visual functions being required which could be associated with errors. Nonetheless the conventional prior art methods and the devices developed for such shifting or displacement of the reed are associated with a series of error sources which appreciably can reduce the quality of the warped package. The warping of a faultless warp upon a warping machine requires an extremely exact depositing of the warp sections. Application of the first warp section at which the first thread of the warp section at the side of the cone must be directly fixed at the transition between the cone and the cylindrical part of the warping drum at such warping drum, can be accomplished by the operator with the necessary precision if the work is carried out carefully.

On the other hand, the application of the following warp section and all further warp sections, each shifted or displaced by the width of a warp section, upon the drum is however considerably more difficult and delicate. If, for instance, the first thread of a new warp section is applied in a faulty manner at a spacing from the last thread of the preceding warp section, and which does not exactly correspond to the spacing of neighboring threads within the warp section, then with too great spacing there is formed at a fabric produced from such warp, a passage or gap at the corresponding location, resulting in rejection of the manufactured goods. On the other hand, if the spacing is too small, then during the winding operation marginal threads of the new warp section can overlie marginal threads of the preceding wound warp section, which then during beaming of a warp package having such flaws can lead to thread rupture.

SUMMARY OF THE INVENTION

Hence, with the foregoing in mind it is a primary object of the present invention to provide a new and improved construction of apparatus for controlling the movements of a reed carriage of a warping machine during warping a package in a manner which is not associated with the aforementioned drawbacks and limitations of the prior art equipment.

Another significant object of the present invention, particularly in view of the difficulties and sources of error, which will be still further considered in detail hereinafter, during locating, guiding and positioning of the reed in the correct position for a clean and correct warping as experienced with the state-of-the-art methods, resides in the provision of an apparatus which completely automatically controls the movements of the reed carriage carrying the reed of a warping machine during the warping of a package composed of successive adjacent warp sections wound onto the warping drum, and thus eliminates the shortcomings of the heretofore known methods and equipment used for the performance thereof.

Now in order to implement these and still further objects of the invention, which will become more readily apparent as the description proceeds, the apparatus of the present development is manifested by the features that there is provided a processor which based upon infed data concerning the predetermined thread number for shifting the reed carriage during winding a warp section determines the requisite number of revolutions of the reed carriage-displacement spindle, and on the basis of further infed data concerning the warp sections which are to be wound determines the number of revolutions of the spindle in the opposite rotational direction needed in order to displace the carriage, following completion of the winding of a warp section, back into the starting position for the winding of the next warp section. The processor furthermore emits signals, upon recall, which through the intermediary of further means brings about such return displacement of the reed carriage.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 5*a*, 5*b*, 5*c*, 5*d* and 5*e* illustrate five of a large number of variants of warp chains, the production of which can be controlled with the inventive apparatus; and FIG. 6 is a flow diagram of a warping installation equipped with the inventive control apparatus.

DETAILED DESCRIPTION OF THE PREFERRED EMBODIMENTS

Figure 1:
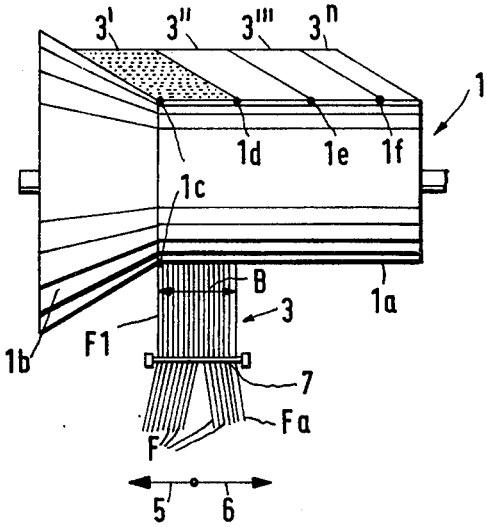
FIG.1 PRIOR ART
FIG. 1 schematically illustrates the parts of a cone sectional warping machine needed for explaining the operations during warping as contemplated by the present invention.
Figure 3:
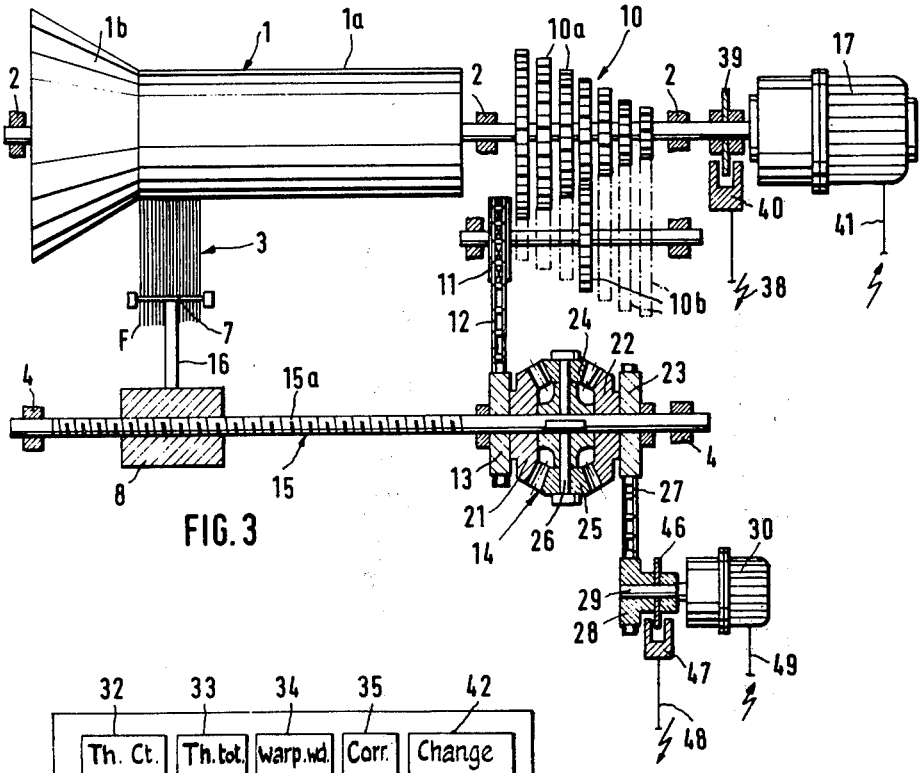
FIG. 3 illustrates the parts of a cone sectional warping machine needed for explaining the principles of the invention and which warping machine is equipped with a control apparatus of the present invention.

Describing now the drawings, in FIGS. 1 and 3 reference character 1 designates a conventionally constructed warping drum or reel, which in standard fashion is mounted at both ends in the bearings 2 of a not further illustrated machine frame. Furthermore, as indicated in FIG. 3 this warping drum 1 can be rotatably driven by any suitable drive motor 17.

The warping drum 1 will be seen to comprise a substantially cylindrical portion 1*a* at one of which there adjoins the warping cone 1*b* which is usually displaceable in a manner well known in the art and which, in accordance with the inclination of the cone 1*b*, supports successively wound layers of the first wound warp section. Each warp section 3 consists of a multiplicity of individual threads or yarns F — hereinafter simply referred to as threads — which are withdrawn from bobbins mounted upon a warp or beaming creel and can be guided in a predetermined sequence and number through a reed 7 for forming a warp section, the reed 7 producing the desired width of the warp section and the set of warp. Details of the bobbins and the warp creel are unnecessary for understanding the underlying principles of the present invention, and conventional arrangements can be used. Details of a possible construction of beaming creel which can be employed have been disclosed in my aforementioned commonly assigned, co-pending U.S. application, Ser. No. 789,545, filed Apr. 21, 1977, entitled "Apparatus for Controlling Application of Warp Sections during Warping", now U.S. Pat. No. 4,074,404, 2/21/78, the disclosure of which is incorporated herein by reference.

At the beginning of the warping process, the first warp section 3′ (FIG. 1) is connected to the warping drum or reel 1 by the operator. To ensure that there is formed a proper package, it is absolutely necessary that the first thread F1 (FIG. 1) of this warp section 3′, and which thread is located at the side of the cone 1*b*, is applied exactly at its point of attack at the line of contact 1*c* between the cylindrical part 1*a* and the cone 1*b* of the warping drum 1. Now the warping drum 1 is placed into rotation by the drive motor 17 and there is wound the first warping section 3′. The control of deposition of the individual layers of the warp section along the cone 1*b* is accomplished as a function of the rotation of the warping from drum 1 by means of a change-speed gearing 10 having a multiplicity of driving gears 10*a* and driven gears 10*b*, as best seen by referring to FIGS. 3. The selection and purpose of the change-speed gearing or transmission 10 will be explained more fully hereinafter. The specific one of the change-speed gears 10*b* which is driven, in turn drives by means of a sprocket gear or wheel 11 and a chain 12 a sprocket gear or wheel 13. The sprocket gear 13 drives by means of a differential gearing, generally indicated by reference character 14 and the function of which will be explained more fully hereinafter, a reed carriage-displacement spindle 15, which, in turn, is mounted in bearings 4 (FIG. 3) of the machine frame. Engaging with the threading 15*a* of the spindle 15 is the schematically indicated warping or reed carriage 8 which carries the reed 7 by means of a holder 16.

Rotation of the warping drum or reel 1 in the direction of winding brings about, by means of the change-speed gearing 10, the sprocket chain drive 11, 12, 13 and the differential gearing 14, rotation of the spindle 15, and thus, continuous displacement or shifting of the reed carriage 8. Due to the movement of the reed carriage 8 there is also correspondingly displaced the reed 7 which guides the warp section in the direction of the arrow 5 (FIG. 1), in a manner such that the warp section, as illustrated, is wound at an inclination along the cone 1*b* of the warping drum 1.

After reaching the desired length of the warp chain which is subjected to the warping operation, then the warping drum 1 is stopped. Hence, winding of the first warp section 3′ is completed. Now for warping the second warping section 3″ the reed carriage 8 together with the reed 7 must be displaced in the direction of the arrow 6 into a new starting position which ensures that the first thread, at the side of the cone 1*b* of the warp section 3″which now is to be wound arrives in the set of warp exactly at the appropriate spacing from the last thread Fa of the already warped first section 3′ upon the warping drum 1, i.e., arrives at the new point of attack 1*d*.

Now in the same manner as for the first warp section 3′, and subsequent to the warping operation carried out thereat, the second warp section 3″ is exposed to the warping operation until reaching the same length upon the winding or warping drum 1 and the operation is repeated with the further warp sections 3‴ to $3^n$ until the warp chain has undergone the warping operation at the drum 1 over its full width.

Since, as previously mentioned, there is required a very exact deposition of the warp section upon the warping drum 1 in order to thereafter avoid rejects and losses, and since the application of the individual warp sections constitutes one of the most frequent sources of errors, there will be considered more fully in the description to follow this problem, and at the same time there will be discussed the drawbacks of the state-of-the-art operational modes with a so-called warp section width-adjustment device of known construction.

The location of the point of application for the first thread F1 of the first warp section 3' at the warping drum 1 at the side of the cone 1*b*, as a general rule is not associated with any difficulties. The difficulties first arise during determination of the correct point of attack or application 1*d* of the first thread of the second warp section 3' and the relevant points of attack or application of the following warp sections 3'' to $3^n$.

A simple, extensively employed auxiliary device, which facilitates the location of such points of application or attack, as shown in phantom lines in FIGS. 2*a* to 2*d*, consists of a measuring rod 9 which is attached to the reed carriage 8 carrying the reed 7 so as to protrude therefrom with adjustable length in a direction parallel to the reed carriage-displacement spindle 15. The measuring rod 9 has a stop or impact member 18 which is adjustably positionable and fixable in the adjusted position upon a machine frame part (not shown) parallel to the spindle 15 and further includes a flap or tongue 19 which can be pulled-out or rocked-out. Prior to winding the first warp section 3' and as best seen by referring to FIG. 2*a*, the measuring rod 9 is pulled-out through a length corresponding to the warp section-width B which is to be warped and then fixed in position. Thereafter the stop 18 with the pivoted-out or rocked-out flap or tongue 19 is pushed against the measuring rod 9 and fixed in position.

Figure 2A:
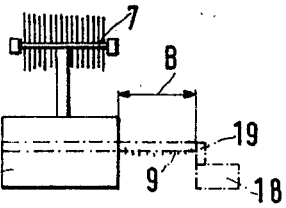
FIGS. 2*a*, 2*b*, 2*c* and 2*d* constitute respective schematic illustrations of the working operations accomplished when using a conventional warp section width-adjustment device of the prior art.
Figure 2B:
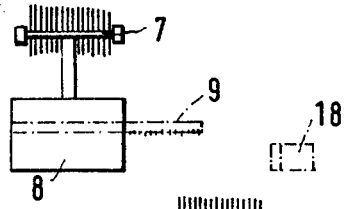

Now during the following warping of the first warp section 3', due to the rotation of the threaded spindle 15, the reed carriage 8 together with the measuring rod 9 and the reed 7 moves away in the direction of the arrow 5 from the stop 18, as best seen by referring to FIG. 2*b*.

Figure 2C:
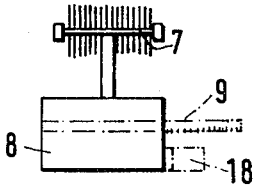
Figure 2D:
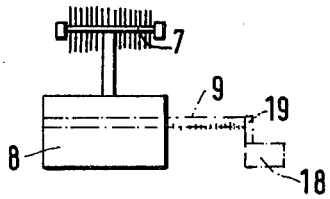

Following completion of the winding-up of the first warp section 3', and with the warping drum 1 stationary, the reed carriage 7 is disengaged from the displacement spindle 15 and shifted in the direction of the arrow 6 of FIG. 1 until striking against the stop or impact member 18 so as to assume the position shown in FIG. 2*c*. This position of the reed carriage 8 constitutes the starting position for the winding process of the warp section 3''. Prior to start of winding such second warp section 3'' the operator must fix the position of the warp section 3''', for which purpose, as best seen by referring to FIG. 2*d*, they must displace the stop 18 with the pivoted-out flap or tongue 19 towards the measuring rod 9 until contacting the latter and then the stop 18 is positionally fixed. Consequently, on the one hand there is ensured the point of attack of the new warp section and, on the other hand, there is again predetermined the following point of attack.

During the determination and fixation of the points of attack or application of the warp sections according to these conventional techniques, experience has shown that there can arise an entire spate of errors, in that for instance:

(a) The measuring rod 9 is not correctly pulled-out exactly in accordance with the determined warp section-width B;

(b) The measuring rod 9 is not adequately positionally fixed;

(c) The stop 18, for positioning purposes, has not been completely correctly pushed with its retracted or drawn-out flap 19 against the measuring rod;

(d) The flap 19 is not again pivoted-in;

(e) The stop 18 has not been adequately fixed;

(f) Displacement of the stop 18 has been forgotten;

(g) During displacing back the reed carriage 8 in the direction of the arrow 6, its approach at the stop 18 has not been carried out carefully, so that the stop 18 is not displaced; and (h) There is improper contact between the reed carriage 8 and the stop 18.

Each individual one of these errors can place in doubt the entire previously carried out work and can constitute a cause for producing reject goods or losses in material.

Quite frequently and oftentimes without being noticed errors arise during return of the reed carriage 8 with the reed 7 back to the stop 18 as explained above in item (g). Since the carriage 8 with the reed 7 has a considerable weight and, according to the described conventional technique, must be displaced manually by the operator against the stop or impact member 18, it is possible that if the carriage 8 strikes the stop 18 too hard and the stop possibly has not been sufficiently fixed in position, then the latter will be somewhat shifted upon such impact. Consequently, the point of attack of the warp section is falsified. Even if such unintentional shifting or displacement of the stop 18 is noticed by the operator, they are no longer in a position to again locate the correct point of attack with the aid of the auxiliary device, rather the correct point of attack which is now lost must be located visually. This, of course, is associated with a correspondingly increased error risk.

Similar difficulties arise if, as often happens, a warp section is to be wound as a so-called residual warp section with fewer threads, i.e., reduced width of the warp section. This is not associated with any particular difficulties if the threads can be removed from the last warp thread to the right of the thread Fa of the warp section in the direction of the arrow 5. In this case the conditions remain, provided that one is dealing with the last warp section $3^n$, as illustrated in FIGS. 2*a* to 2*d*.

With the just described warp section width-adjustment device it is therefore only possible to remove threads at the last warp section $3^n$, and specifically only from the last warp thread to the right of the thread Fa of the warp section in the direction of the arrow 5. Other changes in the number of threads of the warp section or the warp sections are not possible, unless the application of the new warp section is accomplished visually, in which case there then can arise all of the previously mentioned difficulties, such as the formation of passages or crossed threads.

Now with the apparatus of the invention which will be described in detail hereinafter there are eliminated all of the previously discussed sources of error.

The differential gearing 14 possesses two drive gears 21 and 22, of which the first drive gear 21 is fixedly connected with the sprocket gear or wheel 13 and the oppositely situated second drive gear 22 is fixedly connected with a further sprocket gear or wheel 23. The drive gears 21 and 22 as well as the sprocket gears or wheels 13 and 23 are mounted to be freely rotatable upon the reed carriage-displacement spindle 15. The drive gears 21 and 22 mesh with planetary gears 24 and 25 mounted at the planetary web 26 of the differential gearing 14. The planetary web 26 is keyed so as to be fixedly rotatable with the spindle 15. The sprocket wheel 23 is drivingly connected by means of a chain 27 with a sprocket wheel 28 seated upon the power takeoff shaft 29 of a direct current transmission or gearing motor 30 or equivalent drive.

During the preparation of a warping process there is selected, based upon empirical values, the transmission ratio of the change-speed gearing 10 needed for the desired application of the warp section while taking into account the cone angle, the thread material to be processed and other parameters.

Now if with the motor 30 blocked and thus the gears 22 and 23 locked, the motor 17 is placed into operation and hence the warping drum 1 is rotated for the purpose of warping a warp section, then such rotation is transmitted by means of the selected change-gear transmission ratio governed for instance by the gears 10*a*, 10*b* to the sprocket wheel 11 and by means of the chain 12 and the sprocket wheel 13 to the drive gear 21 of the differential gearing 14, which drive gear 21 is flanged to the sprocket wheel 13. Such drives the planetary gears 24 and 25 which roll upon the stationary drive gear 22 and thus place into rotation the planetary web 26 and by means of such the reed carriage-displacement spindle 15. This displacement spindle 15 causes, by means of its threading 15*a*, the continuous shifting or displacement of the reed carriage 8 and together therewith the reed 7 in the direction of the arrow 5, in order to bring about the deposition of the individual layers of the just warped section at the inclination corresponding to the cone angle. If there is imagined that the gearing 14 is not present and the sprocket wheel 13 is fixedly seated upon the spindle 15, then this operation corresponds to that which prevails at a conventional warping machine. While, however, with such conventional equipment, following the warping operation of each warp section the carriage 8 must be disengaged from the spindle 15 and possibly shifted to the correct position for the warping of the next warp section with the aid of the adjustment devices as such have been explained in conjunction with FIGS. 2*a* to 2*d* and at that location again brought into engagement with the spindle threading 15*a*, with the illustrated apparatus of the invention such working operations which can lead to errors are completely eliminated.

Figure 4:
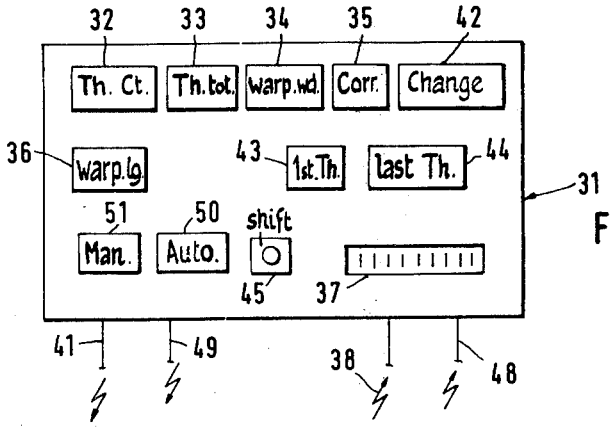
FIG. 4 is a simplified illustration of the operating position or control console for controlling the warping machine shown in FIG. 3.

The illustrated warping machine is equipped for this purpose with a processor which, on the one hand, is a data carrier and storage and, on the other hand, derives data for the production of the warp. In FIG. 4 the operating console or control panel of the processor, generally indicated by reference character 31, has been shown with the indicators or displays, operating keys and inputs and outputs of interest. Further operating keys, display or indicator fields as well as inputs and outputs of such processor for the control of additional operations during warping, for instance for the control of the application of the warp sections according to the aforementioned co-pending United States application, Ser. No. 789,545, for the measurment of the warp length during the winding operation, for the speed and thread tension regulation during winding and unwinding, for the cut length marking and so forth by the same processor 31 have been conveniently omitted from the schematic illustration of FIG. 4 to simplify the showing thereof. There are different types of control processors 31 which can be used for the practice of the invention; one suitable type being the commercially available model known as Intel 8080 CPU, manufactured by the well known German firm Siemens AG.

By means of standard preselector switches 32, 33, 34 and 35 it is possible to set at the processor 31 the fixed values for a certain warp disposition and to store such for the entire warping process. Specifically, at the switch 32 there can be set the thread or yarn count (Td. Ct.), at the switch 33 the total number of threads (Td. tot.), at the switch 34 the warp width (Wp. Wd.), and at the switch 35 the correction factor (Corr.).

Based upon the textile technological and mechanical data infed to the processor 31 the latter is in the position of computing the resultant mean or average thickness of the warping sections and derived therefrom, with the aid of the warp length which is to be subjected to the warping process and introduced by means of the further preselector switch 36, to calculate the number of revolutions of the warping drum 1 which are needed to obtain this preselected warp length while taking into account the winding or package diameter which continuously increases in size during the winding operation. The processor 31 continuously computes this value and the resultant momentary calculated reference-warp length is digitally displayed in a data field or zone 37. The correction factor which as a general rule is determined in the laboratory for a pre-given warping arrangement and introduced at the switch 35, takes into account the variables which have an effect upon the application of a warp section, particularly whether the thread material which is being processed is bulky or voluminous or non-bulky, dyed or non-dyed material, the extent to which the material has been possibly twisted, and whether the material is formed of natural fibers or synthetic fibers.

By means of the values concerning the total number of threads and the warp width which are introduced by the switches 33 and 34, it is possible to determine the thread number per centimeter of the warp which is to be subjected to the warping operation, and by means of the number of threads per warping section 3 it is thus also possible to determine the required warping section-width B, which then is set in conventional manner at the reed 7. Prior to the start of a warping process the operator applies the first warping section 3' such that its first thread F1 at the cone side of the warping drum 1 comes to lie at the point of attack or application 1*c* (FIG. 1). The reed carriage 8 together with the reed 7 is then brought into engagement at the corresponding location of the reed carriage-displacement spindle 15 with the threads or threading 15*a* thereof. After placing into operation the warping machine the warp section 3' is wound onto the warping drum 1. At the same time by the means of the change-speed gearing 10, the sprocket gearing or drive 11, 12, 13 and the differential gearing 14 and the reed carriage-displacement spindle 15 the reed carriage 8 and together therewith the reed 7 is continuously shifted in the direction of the arrow 5 of FIG. 1, in order to produce the shifted deposition of the wound-up layers of the warp section exactly along the conical part 1*b* of the warping drum 1.

The winding operation continues for such length of time until the number of revolutions of the warping drum 1, determined by the processor 31 for the desired warp length infed thereto by means of the switch 36 corresponds to the actual number of revolutions which have been infed to the processor 31 as the input 38 from a pulse disk 39 seated upon the shaft of the warping drum 1 and by means of a pulse transmitter 40. The pulses which are delivered by the pulse transmitter 40 to the processor 31 enable the processor 31, in conjunction with the calculated warp section-thickness for the infed fixed data, to compute at any point in time the warp length which is to be wound-up at such point in time. This momentary warp length, which by the way is continuously digitally displayed in the display or indicator field 37, is simultaneously compared by the processor 31 with the desired warp length stored by means of the preselector switch 36 and upon reaching the desired warp length the processor 31 delivers an output signal by means of the line or conductor 41, which, through the agency of not further particularly illustrated but conventional electromechanical means, shuts-off the drive motor 17 and immediately interrupts the winding operation, and thus, at the same time also stops the reed carriage-displacement spindle 15 and by means of the latter the reed carriage 8 together with the reed 7.

During the thus terminated winding operation for the warp section 3', the reed carriage 8 is shifted by the reed carriage-displacement spindle 15 from its starting position according to the showing of FIG. 2*a*, corresponding to the point of attack 1*c* for the first thread F1, in the direction of the arrow 5 into the position according to the showing of FIG. 2*b*. In this position the warp section 3' has been completely wound in accordance with the set warp length and there has been achieved the warp section-application.

A pre-requisite that the continuous displacement of the reed 7 in the direction of the arrow 5 during the winding operation ensures for the correct shifted or offset deposition of the layers of the warp sections, is the correct selection of the transmission gears 10*a*, 10*b* of the change-speed gearing 10. The selection and adjustment of such transmission ratio is accomplished mechanically in conventional manner, however with the described deposition of the warp sections this transmission ratio can be set by means of a further preselector switch (Change) 42 in the processor 31.

So that it is no longer necessary, as previously mentioned at the outset of this disclosure, to decouple the reed carriage from its spindle after winding each warp section and after the determination thereof to shift such into the correct position for the winding of the next warp section, there is employed the processor 31. It should be capable of determining the number of revolutions of the reed carriage-displacement spindle 15 which are needed in order, on the one hand, to return the carriage 8 in the direction of the arrow 6 out of the position of FIG. 2*b* into the position of FIG. 2*a* and, on the other hand, to further guide such out of this position according to the showing of FIG. 2*a* into that of the showing of FIG. 2*c*, which constitutes the position for the correct application of the first thread at the cone-side of the winding drum 1 of the next warp section which is to be wound. The first mentioned number of revolutions can be calculated by the processor 31 from the values which have been infed thereto by means of the preselector switches 32–35. It is the same number which shifts the reed carriage during the winding of the warp section from its starting position continuously into the position which it assumes after reaching the desired deposition, i.e., warp length and the shutting-off of the rotation of the warping drum 1.

In order to determine the second one of the aforementioned rotational speeds the operator must introduce to the processor 31 data concerning the first thread F1 at the side of the cone 1*b* as well as data concerning the last thread F*a* of the next warping section to be wound. To this end the illustrated processor 31 has two further preselector switches 43 (1st Td.) and 44 (last Td.). To facilitate the work for the operator the infeed of such data by means of the switches 43 and 44 occurs in a manner such that for the first thread there is introduced at the switch 43 the number "1" and for the last thread there is introduced into the switch 44 the number corresponding to the number of threads of the warping section. The operator can take this value from the arrangement or disposition card which they receive in the form of the warping assignment or order prior to beginning with the work.

With the aid of the data "Thread Total" and "Warp Width" which is introduced by means of the switches 33 and 34 to the processor 31 and equally by means of the data introduced by means of the switches 43 and 44, this processor 31 can calculate the number of revolutions of the spindle 15 which are needed in order to displace the reed carriage 8 in the direction of the arrow 6 out of its position as shown in FIG. 2*a* into the position according to FIG. 2*c* and to add such value to the number of revolutions of the spindle 15 which displaced the carriage 8, during the winding of the warp section, in the direction of the arrow 5 from the position shown in FIG. 2*a* into the position shown in FIG. 2*b*.

This stored value can be recalled and for the completely automatic displacement of the reed carriage 8 to the point of application or attack of the next warp section to be warped, can be used as soon as the warping drum of the warping machine stops after having completed the warping operation at the first warp section.

To this end the processor 31 advantageously possesses a push-button 45 or equivalent structure which is marked "Displacement" or "Shift". Actuation of this pushbutton 45 places into rotation the direct current transmission motor 30 which, by means of the sprocket wheel 28, chain drive 27, sprocket wheel 23, drive gear 22, planetary gears 24, 25, and via the planetary web 26 which is fixedly connected with the warping or reed carriage spindle 15, places such spindle 15 into rotation in the opposite sense. Consequently, there is now accomplished an oppositely directed shifting or displacement of the reed carriage 8 in the direction of the arrow 6, and specifically, for such of length of time and to such an extent until the number of pulses which have been supplied by means of the pulse disk 46, the transmitter 47 and the electrical connection 48 to the processor 31 co-incide with the number of pulses which have been determined within the processor itself.

Upon reaching such co-incidence the processor 31 emits a signal by means of a line or conductor 49 which stops the motor 30.

At this point in time the reed carriage is located in the position according to the showing of FIG. 2*c*, i.e., exactly in the position where the first thread to the left of the new warp section is located at the point of attack 1*d* for the second warp section 3''' to be wound.

In order to accomplish such displacement the operator only need actuate the "Displacement" push-button 45 and all of the previously mentioned problems which arose during shifting of the reed carriage 8 are no longer present. Furthermore, during the completely automatic return shifting of the reed carriage to the point of attack of the next warp section the operator can carry out other work.

The return displacement of the carriage 8 in the direction of the arrow 6 into the position for the warping of the following warp section is advantageously, of course, accomplished in a rapid operation, i.e., considerably quicker than that in the direction of the arrow 5 during warping.

After the next warp section 3'' has again been secured to the warping drum 1 the winding process can be continued and the warp section 3'' can be wound. As a result, the reed carriage 8 is shifted in the already described manner again in the direction of the arrow 5 for such length of time until the warp length, corresponding to the desired application of the warp section, also is wound for the warp section 3''. There is again accomplished, following actuation of the pushbutton 45, the return displacement of the reed carriage 8 in the direction of the arrow 6 with the warping drum 1 stationary, and specifically, through the last performed displacement in the direction of the arrow 5 increased by the width of the warp section, to the new point of attack 1*e* (FIG. 1) for the warp section 3'''. This procedure is repeated until all of the warp sections of the same width have been wound onto the warping drum 1.

In practice it oftentimes happens that, in order to avoid exceeding the total number of threads of the chain which is to be warped, the last warp section which is the socalled residual warp section $3^n$, i.e., as the warp section with fewer threads than the preceding warp sections 3', 3'' and so forth, must be warped.

Heretofore, for this purpose, it was necessary for the last warp section to be wound, starting from the last thread Fa to reduce the thread number from the right thereof towards the left in accordance with the warp disposition or arrangement, something which also could be accomplished with conventional means, since upon removal of warp threads starting at the right of the warp section, there remains unchanged the system of application of the reed carriage 8. The omission of warp threads or also the addition of warp threads was, however, previously not possible at any other location than at the last warp section starting from the right.

The addition and removal of warp threads within the warp chain of a warp section from the left or from the right would, however, render possible an optimum utilization of the warping principle and have a particularly beneficial effect for patterned warps.

Now with the described apparatus this advantage can be realized as will be explained hereinafter.

As already mentioned, in the preselector switches 43 and 44 there are introduced in each case the first thread to the left and the last thread to the right of a warp section. If, for instance, there should be wound a warping arrangement where one or a number of the warp sections must have fewer threads at the left side, then there must be initially or thereafter, as the case may be, again introduced the removal of such threads by means of the preselector switch 43. At the preselector switch 44 there is introduced the removal or addition of threads at the right side.

In order to better explain this principle of operation there have been graphically illustrated different possibilities in FIGS. 5*a* to 5*e* which, of course, can be randomly expanded upon.

Considering now FIG. 5*a*, it is assumed that the warping creel is suitable for receiving 500 bobbins, the total thread number is 2,000 (preselector switch 33) and there should be wound four warp sections 3', 3'', 3''', and 3'''', each of which should have the same thread count or number. The operator then for this purpose must introduce at the preselector switch 43 the number "1" and at the switch 44 the number "500".

The processor 31 computes and controls always the same value for the displacement of the carriage for all of the four warp sections. The operator, during the entire winding process, need not carry out any other adjustment or setting and need only actuate the push-button 45.

With the showing of FIG. 5*b* the last warp section should be wound as a so-called residual warp section with, starting from the right, 100 fewer threads, in other words a total of 400 threads instead of 500 threads. In order to be able to warp this chain, the operator must introduce at the preselector switch 43 the number "1" for the warp sections 3', 3'', and 3''' and at the preselector switch 44 the number "500" as in the preceding example.

With the residual warp section 3'''' there need not be carried out any setting of the preselector switch 43, but on the other hand there must be keyed into the preselector switch 44 the number "400".

The displacement from position 1*c* to position 1*d*, from position 1*d* to 1*e*, and from position 1*e* to position 1*f* is always the same, as moreover is also the case during the example discussed in conjunction with FIG. 5*a*.

Turning now to FIG. 5*c* and in contrast to FIG. 5*b* the last warp section, likewise a residual warp section, should be wound, starting from the left with 100 fewer threads.

In order to be able to warp this chain, the operator must introduce at the preselector switch 43 the number "1" for the warp sections 3', 3'', and 3''' and the number "500" at the preselector switch 44.

Now for the residual warp section 3'''' the preselector switch 44 is left at its setting, i.e., "500", but on the other hand, there must be introduced at the preselector switch 43, the number "101".

The displacement from the position 1*c* to the position 1*d*, and from the position 1*d* to the position 1*e* is accomplished as in the manner of FIGS. 5*a* and 5*b*, but on the other hand the displacement from the position 1*e* to the position 1*f* is greater than in FIG. 5*b*, since the 101st thread comes to lie at the point of attack 1*f*. Such a chain and that of the following examples cannot be subjected to a warping operation with the conventional means.

Now in FIG. 5*d* there is shown a chain wherein threads should be omitted both at the left as well as also at the right of the entire warp width, and specifically at both sides, for instance 50 threads.

In order to bring about the correct displacement of the reed carriage, when the first warp section 3' begins with the 51st thread, there is keyed into the preselector switch 43 for this warp section 3' the number "51" and the preselector switch 44 is set to the number "500". After warping this first warp section 3' the operator, prior to warping the next complete warp section, and prior to triggering the return of the reed carriage by means of the push-button 45 must set the pre-selector switch 43 to the number "1" and to warp the next warp sections 3'' and 3''' with such setting.

At the last warp section three occurs similar conditions as for the example discussed in conjunction with FIG. 5*b* and also corresponds to the displacement from the position 1*d* to the position 1*e*, i.e., at the preselector switch 44 there is reduced the thread count or number to "450" and the displacement from position 1*e* to position 1*f* is the same as for the example of FIG. 5*b*.

Now in FIG. 5*e* and in contrast to the example of FIG. 5*d*, the intermediate warp sections should possess a thread count reduced by 50, whereas the outer warp sections are full or complete warp sections.

The conditions for the first warp section 3' correspond to those of FIG. 5a, equally the displacement from the position 1c to the posistion 1d. For the winding of the warp section 3" the operator does not actuate the preselector switch 43, but on the other hand, there is set at the preselector switch 44 the thread count to "450". After the warp section 3" has been wound then the reed carriage is shifted back from position 1d to position 1e and the displacement is reduced in accordance with the reduced setting of 450 threads. In order to now wind the next warp section 3'", the operator must set the number "51" at the preselector switch 43 and the number "500" at the preselector switch 44. Due to setting of the number "51" the direct current transmission motor 30 is influenced by the computation operations which occur in the processor 31 in such a manner that the reed carriage 8 is forwardly displaced in the direction of the arrow 5, and specifically for such an extent that the 51st thread comes to lie at the point of attack or application 1e. Then there is carried out the normal winding process. Thereafter the operator, for winding the last warp sections 3'"', must set at the preselector switch 43 the number "1". There then is accomplished the displacement from the position 1e to the position 1f and the winding process can be completed with the winding of the warp section 3'"'.

Now in summation, there is shown in FIG. 6 a flow diagram which illustrates the most essential functions. Further, it will be appreciated that the individual steps have been shown distributed in accordance with the manner in which they are accomplished and designated by the reference characters A–F.

At the step or stage A there are illustrated the fixed data. This data is furnished the operator by means of the order card and set at the machine. This fixed data is evaluated in the processor 31 with the input 38 at the stage B, in order to determine the displacement of the reed carriage in the direction of the arrow 5 during winding, as illustrated by the stage C, as the output 41 for the drive motor 17. The stage C thus controls the winding operation.

At the right side of the flow diagram the stage F contains the "variable" data, i.e., the values for the first thread and the last thread. Also this data flows in the form of computer data in the "Computer Data" stage E into the processor 31, and equally the computer data of the stage B.

With both of these values there is produced in the "Displacement" stage D, the output 49 which displaces the reed carriage 8 back in the direction of the arrow 6 as such, on the one hand, is determined by the fixed data of the stage A and the variable data of the stage F.

Finally, it is to be further remarked that it is readily possible to likewise automate the previously mentioned manual application of the first warp section for the first thread F1 to the left of the point of attack 1c in that the reed carriage remains fixed at the spindle and is controlled to such position by means of the processor 31.

By way of completeness it is still here further remarked that for the exact positioning of the point of attack during displacement of the reed carriage 8 in the direction of the arrow 6, prior to reaching the standstill point, i.e., the point of attacks 1d to 1f, the rotational speed of the direct current transmission motor 30 must be reduced from its rapid operational speed to its crawling operational speed. In order to accomplish such change in operation there are not required any further data or elements. In the processor 31 there is automatically reduced for this purpose the thread count or number by a predetermined amount and which has been infed by the switch 44, and upon reaching such value there is accomplished the control from the rapid operational speed to the crawling operational speed.

In order that it is possible to operate, whenever necessary, in the conventional sense, there are advantageously provided at the processor 31 two further switches 50 and 51, the switch 50 serving for "automatic" operation and the switch 51 for "manual" operation. Upon actuation of the switch 50 the displacement of the reed carriage 8 in the direction of the arrow 6 is accomplished automatically in the manner previously described. If the switch 51 is actuated then the automatic mechanism is disconnected and the displacement can be manually accomplished in the sense of the description of FIGS. 2a to 2d.

As is known, it is required that the displacements be transmitted in all instances free of play, i.e., that the displacement both in the direction of the arrow 5 and also in the direction of the arrow 6 be accomplished precisely and without any play. The proposed solution ensures such precise and play-free displacement of the reed or warping carriage. As will be recognized from the showing of FIG. 3, the spindle 15 is rotated during the winding process by means of the chain drive 12, planetary gear 21, planetary gears 24 and 25, and planetary web 26, whereas by means of the chain drive 27 there is driven the drive gear 22 of the stationary part of the planetary gearing.

During the return displacement of the reed carriage in the direction of the arrow 6 the chain drive 12 is stationary, whereas the spindle 15 is rotated by means of the direct current transmission motor 30, chain drive 27, planetary gear 22, planetary gears 24 and 25, and the planetary web 26 in the opposite direction. At this time the drive gear 21 is stationary. The alternate actuation of the drive gears thus produces a spindle rotation which is free of play.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for controlling the movements of a reed carriage carrying a reed of a warping machine during warping a package from warp sections wound in succession next to one another upon the warping drum of the warping machine, comprising:

a warping drum upon which there are wound the warp sections;

a reed carriage cooperating with the warping drum for winding the warp sections thereon;

a reed carried by said warping carriage;

a reed carriage-displacement spindle for displacing the reed carriage in order to produce shifted depositions of the layers of the warp sections during the winding operation;

pre-settable change-speed gearing for driving the spindle as a function of the rotation of the warping drum;

a processor provided for the warping machine;

means for infeeding data relevant to the displacement of the reed carriage during winding of a warp section;

said processor calculating on the basis of the infed data relevant to the displacement of the reed carriage during the winding of a warp section containing a predetermined number of threads the required number of revolutions of the reed carriage-displacement spindle;

means for infeeding further data to the processor regarding the warp sections to be wound;

said processor calculating on the basis of said further data the number of revolutions of the reed carriage-displacement spindle needed to be accomplished in the opposite rotational sense in order to displace the reed carriage-displacement spindle, following completion of the winding of a warp section, back into a starting position for the winding of the next warp section;

said processor delivering upon recall signals;

means responsive to said signals emitted by the processor for initiating the return displacement of the reed carriage.

2. The apparatus as defined in claim 1, wherein:

said processor is structured such that it calculates a value serving as the basis for the return displacement of the reed carriage from infed data relating to the number of revolutions of the reed carriage-displacement spindle for the winding of a warp section and from infed data concerning the thread number of the next warp section to be wound.

3. The apparatus as defined in claim 2, wherein:

said value can be stored in the processor;

said processor having means which when actuated and with the warping drum stationary enables recall of said value in the form of output signals;

a drive motor for the reed carriage-displacement spindle;

a drive motor for driving the warping drum;

said drive motor for the reed carriage-displacement spindle being independent of the drive motor for the warping drum; and said output signals controlling the drive motor for the reed carriage-displacement spindle.

4. The apparatus as defined in claim 3, wherein:

said drive motor for the reed carriage-displacement spindle drives a pulse disk;

a pulse transmitter cooperating with said pulse disk for supplying pulses as an input to the processor;

said pulse disk supplying said pulses by means of the pulse transmitter to the processor;

the pulses supplied to the processor being compared with a reference value representing the number of revolutions of the reed carriage-displacement spindle calculated in the processor for returning the reed carriage into the starting position for the warping of the next warp section and upon reaching such reference value stopping said drive motor for the reed carriage-displacement spindle.

5. The apparatus as defined in claim 3, wherein:

said processor possesses two preselector switches for the infeed of data concerning the thread count of the next warp section to be wound;

one of said two preselector switches serving for the numerical infeed of a value corresponding to a first thread of a warp section to be wound and the other preselector switch serving for the numerical infeed of a value corresponding to the last thread of the warp section to be wound.

6. The apparatus as defined in claim 5, wherein:

said processor is structured such that as a function of the values infed thereto by means of said preselector switches and on the basis of fixed data infed thereto it controls the processor output for controlling the drive motor of the reed carriage-displacement spindle such that the return displacement of the reed carriage is properly accomplished for warp sections having a reduced thread count.

7. The apparatus as defined in claim 2, wherein:

said warping drum includes a shaft carrying a pulse disk;

a pulse transmitter responsive to rotation of the pulse disk for delivering pulses to the processor for the determination of the number of revolutions of the spindle needed during winding of a warp section.

8. An apparatus for controlling the movements of a reed carriage carrying a reed of a warping machine during warping a package from warp sections wound in succession next to one another upon the warping drum of the warping machine, comprising:

a warping drum upon which there are wound the warp sections;

a reed carriage cooperating with the warping drum for winding the warp sections thereon;

a reed carried by said warping carriage;

a reed carriage-displacement spindle for displacing the reed carriage in order to produce shifted depositions of the layers of the warp sections during the winding operation;

pre-settable change-speed gearing for driving the spindle as a function of the rotation of the warping drum;

a processor provided for the warping machine;

means for infeeding data relevant to the displacement of the reed carriage during winding of a warp section;

said processor calculating on the basis of the infed data relevant to the displacement of the reed carriage during the winding of a warp section containing a predetermined number of threads the required number of revolutions of the reed carriage-displacement spindle;

means for infeeding the further data to the processor regarding the warp sections to be wound;

said processor calculating on the basis of said further data the number of revolutions of the reed carriage-displacement spindle needed to be accomplished in the opposite rotational sense in order to displace the reed carriage-displacement spindle, following completion of the winding of a warp section, back into a starting position for the winding of the next warp section;

said processor delivering upon recall signals;

means responsive to said signals emitted by the processor for initiating the return displacement of the reed carriage;

said processor is structured such that it calculates a value serving as the basis for the return displacement of the reed carriage from infed data relating to the number of revolutions of the reed carriage-displacement spindle for the winding of a warp section and from infed data concerning the thread number of the next warp section to be wound;

said value being stored in the processor;

said processor having means which when actuated and with the warping drum stationary enables recall of said value in the form of output signals;

a drive motor for the reed carriage-displacement spindle;

a drive motor for driving the warping drum;

said drive motor for the reed carriage-displacement spindle being independent of the drive motor for the warping drum;

said output signals controlling the drive motor for the reed carriage-displacement spindle;

change speed gearing;

differential gearing for rotation of the reed carriage displacement spindle in both directions of rotation;

said differential gearing having a planetary web which is rigidly connected for rotation with said spindle;

said differential gearing further including two drive gears;

one of said drive gears being connected for rotation by means of the change-speed gearing with the drive motor for the warping drum and the other drive gear being rigidly connected for rotation with the drive motor for the reed carriage-displacement spindle.

9. The apparatus as defined in claim 8, wherein:

said drive motor for the reed carriage-displacement spindle and said differential gearing provides means for more rapidly driving the reed carriage into a starting position for warping a successive warp section than in the opposite direction by means of the drive motor for the warping drum.

10. The apparatus as defined in claim 9, further including:

means for switching the drive of the reed carriage-displacement spindle by means of its drive motor to a lower and a higher speed; and said switching means being controlled from the higher to the lower speeds by the processor shortly prior to reaching the starting position of the reed carriage for the winding of the next warp section.

* * * * *